US008657797B2

(12) United States Patent
Jung et al.

(10) Patent No.: US 8,657,797 B2
(45) Date of Patent: Feb. 25, 2014

(54) HAIR REMOVAL DEVICE

(75) Inventors: Robert Jung, Friedberg (DE); Uwe Bielfeldt, Bad Soden (DE); Thomas Schamberg, Waldsolms (DE)

(73) Assignee: Braun GmbH, Kronberg (DE)

( * ) Notice: Subject to any disclaimer, the term of this patent is extended or adjusted under 35 U.S.C. 154(b) by 664 days.

(21) Appl. No.: 12/878,324

(22) Filed: Sep. 9, 2010

(65) Prior Publication Data

US 2010/0331795 A1 Dec. 30, 2010

Related U.S. Application Data

(63) Continuation of application No. PCT/EP2009/001592, filed on Mar. 6, 2009.

(30) Foreign Application Priority Data

Mar. 13, 2008 (DE) ..... 10 2008 014 016

(51) Int. Cl.
*A61M 35/00* (2006.01)

(52) U.S. Cl.
USPC ..... 604/290; 604/291; 606/133

(58) Field of Classification Search
USPC ..... 604/19, 23, 289–291, 540; 606/36, 101, 606/131, 133, 135; 601/15
See application file for complete search history.

(56) References Cited

U.S. PATENT DOCUMENTS

| | | | | |
|---|---|---|---|---|
| 5,849,018 | A * | 12/1998 | Rosson et al. | 606/133 |
| 6,416,521 | B1 * | 7/2002 | Waldner et al. | 606/133 |
| 6,575,983 | B1 | 6/2003 | Floessholzer et al. | |
| 2002/0049432 | A1 | 4/2002 | Mukai | |
| 2005/0080432 | A1 | 4/2005 | Fertner et al. | |

FOREIGN PATENT DOCUMENTS

| | | | |
|---|---|---|---|
| EP | 0348842 | A2 | 1/1990 |
| EP | 1884172 | A1 | 2/2008 |
| WO | WO 2008010117 | A2 | 1/2008 |
| WO | WO 2009052880 | A1 | 4/2009 |

OTHER PUBLICATIONS

International Search Report dated Jun. 15, 2009, 4 pages.

* cited by examiner

*Primary Examiner* — Jacqueline Stephens
*Assistant Examiner* — Benedict L Hanrahan
(74) *Attorney, Agent, or Firm* — Jeffrey V Bamber; Jerry J Yetter

(57) ABSTRACT

The invention relates to a hair removal device (1) having a hair removal unit (30) and a skin cooling unit (10), wherein the skin cooling unit (10) has a skin contact surface (11), and the skin cooling unit (10) is equipped to apply an application substance (80) onto the skin by way of the skin contact surface (11) during use of the hair removal device. In addition to the cooling of the skin by means of contact cooling, a further cooling effect may also be achieved in such a hair removal device in that an application substance is applied, which contributes to the cooling of the skin, for example, by means of evaporation. The hair removal device may comprise a removable attachment, which also comprises at least the skin.

6 Claims, 3 Drawing Sheets

HAIR REMOVAL DEVICE

CROSS REFERENCE TO RELATED APPLICATIONS

This application is a continuation of prior co-pending International Application No. PCT/EP2009/001592 filed Mar. 6, 2009, designating the United States.

The invention relates to a hair removal device having a skin cooling unit.

Hair removal devices having a skin cooling unit are known. For example, EP 0 348 842 A2 describes a hair removal device having a skin cooling unit that is designed to desensitize the skin prior to hair removal by cooling in order to lessen the feeling of pain upon hair removal.

The problem of the present invention is now to provide a hair removal device that improves upon the prior art.

Recommended is a hair removal device having a hair removal unit and a skin cooling unit. The skin cooling unit has a skin contact surface. The skin cooling unit is equipped so that during use of the hair removal device an application substance is applied to the skin by way of the skin contact surface, in the process cooling the skin contact surface and/or the application substance. The skin cooling unit serves to cool the skin by contact cooling and helps further cool the application substance; this is achieved by evaporation of the application substance or by an endothermic chemical reaction of the application substance.

A skin cooling unit means a unit that cools the skin by contact cooling, wherein the contact cooling is achieved by means of a skin contact surface temperature that is below the ambient temperature (i.e. in particular below a room temperature of the skin contact surface of approximately 21 degrees Celsius). A cooling of the skin is achieved, for example, by a skin contact surface temperature of approximately 10° C. or lower, in particular by temperatures of 0° C. or lower. The skin contact surface can be cooled, for example, by external cooling, for example in a freezer, by cooling by means of thermal contact with a cooled cooling material or by a cooling device, or the cooling of the skin contact surface is achieved by conducting the cooled application substance through the skin contact surface. The skin contact surface is formed by at least one part of the surface of a skin contact element. The application substance can itself be cooled so that a longer-lasting cooling is achieved by applying the application substance to the skin, and/or the application substance releases additional heat from the skin by means of a physical process and/or a chemical reaction. For example, water releases heat energy from the skin when the water applied as an application substance evaporates.

In one embodiment of the hair removal device, at least one part of the skin cooling unit is designed to be cooled in an external cooling process, for example in a freezer. This part of the skin cooling unit can then be configured to be removable.

In another embodiment of the hair removal device, the skin cooling unit has a cooling device that is designed to cool at least one part of the skin cooling unit and/or an application substance and/or a cooling material, wherein the cooling device carries out the cooling before and/or during use of the hair removal device. The cooling device carries out an active cooling so that any warming of the hair removal device during use does not necessarily worsen the skin cooling result.

In a further embodiment of the hair removal device, the skin cooling unit has a rotatable skin contact element whose surface forms at least part of the skin contact surface. A rotatable skin contact element can easily be drawn across the skin and can be put into rotation, for example, by friction contact with the skin, which also enlarges the skin contact surface.

In one embodiment of the hair removal device, a front area of the skin cooling unit for the application substance is porous. The surface of the front area forms at least part of the skin contact surface. The front area can have, for example, perforations, holes or pores through which the application substance reaches the skin. In the case of a cooled front area, the application substance is cooled while it passes through the front area. The front area can be malleable, for example in that it is designed as a compressible sponge, and thus can adjust to surface of the skin. The front area is part of the skin contact element.

In a further embodiment of the hair removal device, the skin contact surface is formed by the surface of a replaceable layer of material. If soiled, this layer of material can be easily replaced so that after it is replaced, the skin only comes in contact with a fresh and clean skin contact surface. In one development of the invention, the application substance is present in the layer of material, for example in that the layer of material is soaked in the application substance. The skin contact element is formed by the layer of material and a skin contact element main body.

In another embodiment of the hair removal device, the skin contact surface is at least partially formed by the surface of solidified application substance. At the same time, it can be, for to example, frozen application substance that upon contact with the skin is applied to the skin by heat and/or friction, which thus desensitizes and/or refreshes the skin as a result of contact cooling and additional cooling by means of the application substance. The skin contact element is then, at a minimum, formed by the solidified application substance. The solidified application substance can also be applied to the main body of a skin contact element.

In an additional embodiment of the hair removal device, the skin cooling unit has a reservoir. The reservoir can serve as a storage container for the application substance. Instead of the application substance, the reservoir may also contain a cooling material. The reservoir may have an opening for filling the reservoir. The hair removal device may, in particular, have two reservoirs that contain, for example, an application substance and the other cooling material. Alternatively, two different application substances can be housed in two reservoirs.

In a further embodiment of the hair removal device, the skin contact surface is prestressed against the skin. This allows the resilient mounting to offset the skin's topology.

In one embodiment of the hair removal device, at least one part of the skin cooling unit comprising the skin contact surface is designed as a replaceable and attachable attachment of the hair removable device. The attachment can thus be removed and cleaned separately or it can be replaced by another attachment.

The invention also relates to an attachment for the main body of a hair removal device, wherein at least one part of the skin cooling unit comprising the skin contact surface is part of the attachment. This allows the attachment to be reversibly attached to the main body of the hair removal device. The attached attachment and the main body of the hair removal device together form a hair removal device pursuant the subject matter of the present invention.

Recommended is a method to remove hair that—without predetermining a chronological sequence of the steps of the method by the sequence of the steps indicated—contains the following steps:

cooling an application substance;

passing over a skin area with a hair removal device, wherein a skin contact surface is brought into contact with the skin;

applying cooled application substance to the skin by means of the skin contact surface; and removing hair from the skin with a hair removal unit of the hair removal device.

The application substance can become cooled, for example, by prior cooling or by cooling when the application substance passes over cooled areas of the skin cooling unit. The application substance can be applied directly before or after the hair is removed. Because removing hair is a continuous process, all steps can also be carried out at the same time.

The invention is also explained in detail by the description of several exemplary embodiments in which reference is made to figures.

Figure 1:
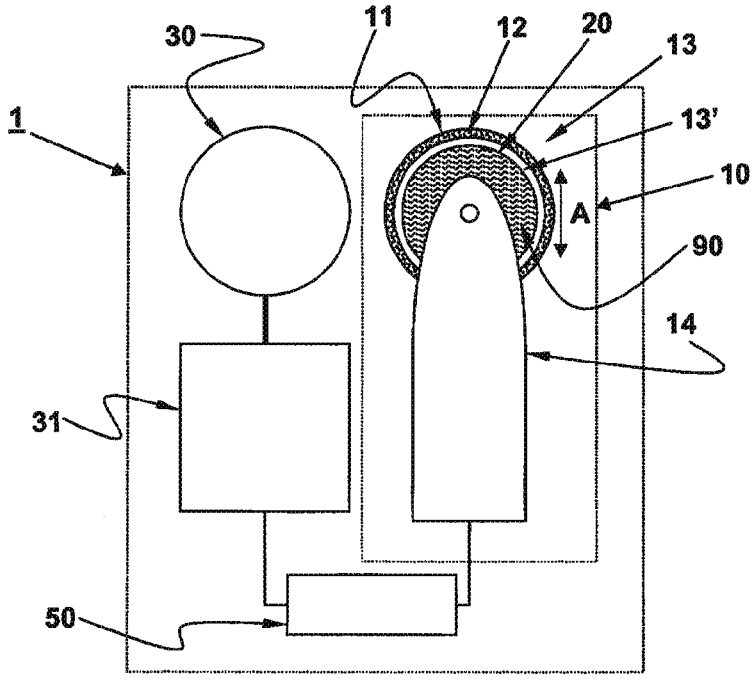
FIG. 1 is a schematic drawing of a hair removal device in one exemplary embodiment.
Figure 4:
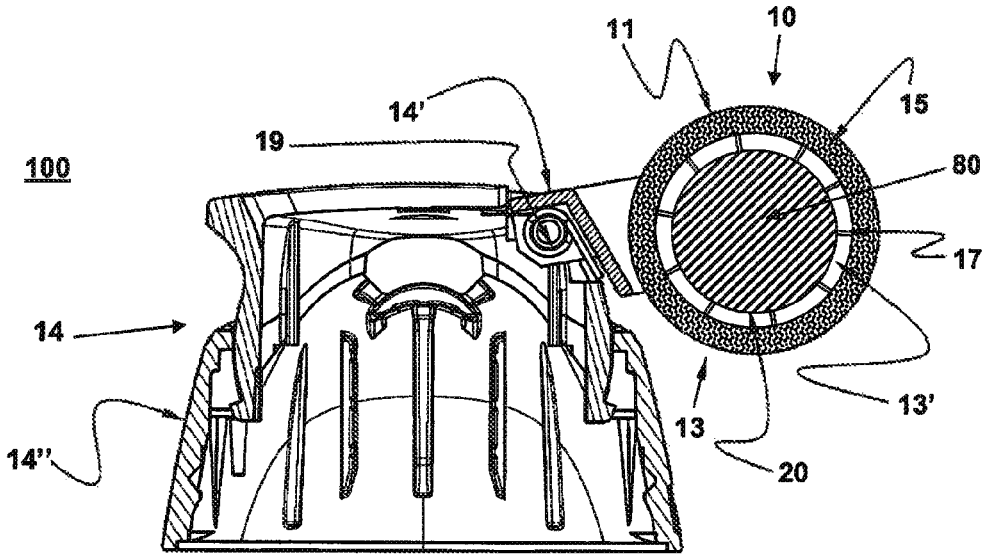
FIG. 4 shows a cross-cut attachment with a skin cooling unit in a further exemplary embodiment.

FIG. 1 schematically shows an exemplary embodiment of a hair removal device 1. The hair removal device 1 has a hair removal unit 30, for example an epilation roller in the case of a hair removal device designed as an epilation device, or a shaving foil head in the case of a hair removal device designed as an electric dry shaver. The hair removal unit 30 is attached to a motor 31, which drives the hair removal unit 30. The motor 31 is powered by an energy source 50, wherein the energy source 50 can be a battery or an accumulator, or the energy source 50 utilizes the line voltage and is a transformer, for example. In this case, the energy source 50 is also attached to the skin cooling unit 10. The skin cooling unit 10 consists of a holder 14 that holds a skin contact element main body 13', wherein in this case the skin contact element main body 13' is cylindrical. The skin contact element main body 13 is covered by a layer of material 12; the layer of material 12 and the skin contact element main body 13' form a skin contact to element 13. The surface of the layer of material 12 (and thus the surface of the skin contact element 13) forms a skin contact surface 11. The skin contact element 13 also has a reservoir 20 in which is found a cooling material 90. The skin contact element 13 can be put into rotation by a drive located in the holder 14 (not shown). However, the cylindrical skin contact element 13 can also be put into rotation by moving the hair removal device 1 over the skin of a user (wherein in this case an attachment to the energy source 50 would not be necessary). To compensate for different angular positions with which the hair removal device 1 is placed onto the skin by the user and to guarantee a skin contact of the skin contact surface 11, the skin contact element 13 is resiliently mounted in the direction of the double arrow A so that a force acting on the skin contact element 13 against an opposing force (in particular an elastic force that is applied by a spring—one such spring 19 is depicted in FIG. 4) pushes it into the device from a starting position, and when the force of the externally applied opposing force is reduced, pushes the skin contact element 13 back in the direction of its starting position.

In the embodiment according to FIG. 1, an application substance is inserted into the layer of material 12. Thus, the layer of material 12 can be, for example, a fleece that is soaked in the application substance. In the simplest case, the application substance is water, but it can also be a special skin treatment agent like the one described, for example, in DE 10 2004 07 376 A1 as a pretreatment agent for hair removal by mechanical epilation. The layer of material 12 is removable and can be attached to the skin contact element main body 13', for which purpose corresponding detachable clamping devices or the like (not shown) can be provided to the skin contact element main body 13'. The layer of material 12 can be, for example, pressed onto protrusions on the skin contact element main body 13'. The protrusions can have, for example, barbs or a raw surface, which helps to keep the layer of material 12 in place.

Before the hair removal device 1 according to FIG. 1 is used, the skin contact element 13 is cooled, in particular by placing the skin contact element 13 in a freezer, so that the cooling material 90 is cooled. At the same time, the layer of material 12 can already be applied to the skin contact element main body 13' during the cooling process so that the application substance inserted into the layer of material is also cooled. In this case, "cooling" means in particular a cooling down to below the ambient temperature. A cooling down to below 0 degrees Celsius desensitizes the skin nerves to any pain from plucking out hair; a cooling down to −18° C. can be achieved during cooling in a typical freezer. If the cooling material 90 is water, the cooling can last, for example, until the water is completely frozen. The cooling material 90 can in particular to be a material known from so-called "cooling packs" (wherein the cooling material can be, instead of a liquid, also a gel or another non-liquid material typically characterized by a high heat storage coefficient). When cooled, such cooling materials carry out phase changes. When heated, the cooling material then reverses the phase changes; the temperature at which the reversal of phase changes takes place remains the same until all cooling material returns to the pre-cooling phase. For example, it is known that an aqueous common salt solution containing 7% NaCl carries out a phase change from solid to liquid at a temperature of approximately −6° C. Alternatively, the cooling material can consist of two components that, when combined, draw heat energy from the surrounding area by means of an endothermic reaction. To that end, an opening (not shown) may be provided through which the reservoir 20 can be filled with the cooling material, so that the endothermic reaction only takes place shortly before the start of use and, in the embodiment shown, cools the skin contact element main body 13' and the layer of material 12 attached to it along with the application substance contained within it. Of course, an opening can also be provided in general so that a cooling material 90 can be filled into the reservoir 20 and removed again from it.

During use, the hair removal device 1 is moved across the skin and the top layers of skin are cooled by contact with the skin contact surface 11 of the skin cooling unit 10. As a result of the warmth of the skin and the pressure with which the hair removal device 1 is pressed against the skin, the application substance is released from the layer of material 12 and applied equally onto the skin. By evaporation on the skin and, depending on the composition, by the addition, for example, of cooling ingredients such as alcohol, menthol or Frescolat®, the application substance itself produces an additional cooling effect greater than the simple contact cooling produced by the contact of the skin with a skin contact surface of a skin cooling unit like the one known, for example, from EP 0 348 842 A2. At the same time, cooling the skin prior to hair removal counteracts the sensation of pain caused by removing hair, and cooling the skin after hair removal refreshes and calms irritated skin Depending on the intended use, the skin cooling unit 10 is arranged on the hair removal device 1 so that during use of the hair removal unit 30, it is arranged upstream or downstream of the direction of use. Of course a hair removal device 1 may also be provided with two skin cooling units 10 so that one instance of cooling can be carried out before the hair removal process and one can be carried out after. Instead of one skin cooling unit 10, more than one skin cooling unit of the hair removal unit can be arranged upstream.

If, for example, the layer of material 12 is a fleece that is soaked in the application substance, it can be provided that the layer of material 12 is to be replaced after a certain period of use because the application substance will then have been used up. The necessity of replacing the layer of material 12 is indicated to the user by an indicator (for example an LED or an acoustic signal). The indicator is controlled by a control unit that measures the period of use and after a predetermined period of use expires, triggers the optical signal. Instead of an indicator that only indicates something when the layer of material has to be changed, an indicator that continuously indicates the status of the unit in question can also be used, for example an indicator that changes color from green to red, wherein the change to red indicates the necessity of replacing the layer of material 12. Instead of only changing the layer of material, it can also be provided that the skin contact element 13, including the layer of material 12, has to be replaced.

Figure 2:
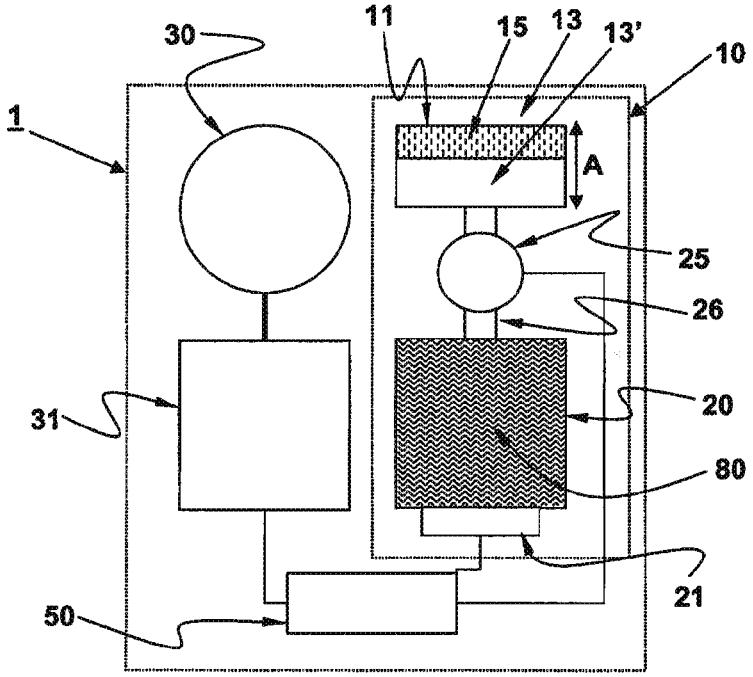
FIG. 2 is a schematic drawing of a hair removal device in a further exemplary embodiment.

Instead of or in addition to cooling the skin cooling element 10 and the cooling material 90 by external cooling, the skin cooling element 10 can also be actively cooled by a cooling device (reference number 21 in FIG. 2). This device is explained in detail in connection with the exemplary embodiment according to FIG. 2.

In addition to the components already mentioned, the application substance can also contain skin-care substances and/or anti-irritative additives.

FIG. 2 schematically depicts a further exemplary embodiment of a hair removal device 1. In addition, in this embodiment the hair removal device 1 has a hair removal unit 30, for example an epilation roller in the case of a hair removal device designed as an epilation device, or a shaving foil head in the case of a hair removal device designed as an electric dry shaver. The hair removal unit 30 is attached to a motor 31 that drives the hair removal unit 30. The motor 31 is powered by an energy source 50, wherein the energy source 50 can be a battery or an accumulator, or the energy source 50 utilizes the line voltage and is a transformer, for example. In this case, the energy source 50 is also attached to the skin cooling unit 10.

In the exemplary embodiment according to FIG. 2, the skin cooling unit 10 has a skin contact element 13 that has a porous front area 15 that is arranged on a skin contact element main body 13'. The skin contact element 13' touches the skin with the skin contact surface 11. The skin contact element 13 is attached to a reservoir 20 by means of a liquid line 26. Within the reservoir 20 is an application substance 80 that during operation is conveyed by means of a pump 25 through the liquid line 26 to the skin contact element 13. Within the skin contact element 13 are channels and/or a cavity (neither of which are shown) through which the application substance 80 is fed to the porous front area 15, which is permeable for the application substance, of the skin contact element 13. The front area 15 can consist, for example, of a sponge material.

In the exemplary embodiment shown, the reservoir 20 is thermally attached to a cooling device 21, for example a Peltier element, to cool the application substance 80. The cooling device 21 can have a temperature sensor (not shown) for monitoring the temperature of the application substance 80, wherein the control unit (not shown) controls the cooling device so that the temperature of the application substance 80 does not exceed a predetermined temperature. This ensures that the cooling device 21 does not freeze the application substance 80 and that the application substance 80 in the embodiment shown can continue to be conveyed by the liquid line 26 and the pump 25 to the skin contact element 13. During transport to the skin, the application substance 80 cools the skin contact element 13. Alternatively and/or in addition, it can be provided that the skin contact element 13 is cooled thermoelectrically by a cooling device. In that case, the application substance 80 would be further cooled during transport through the cooled areas of the skin cooling unit before it is applied to the skin. Alternatively and/or in addition, the skin contact element 13 can also have a reservoir containing a cooling material like the one described in the exemplary embodiment according to FIG. 1. A reservoir containing cooling material that cools the application substance can also be provided near the reservoir for the application substance. For example, the skin contact element can be a thermal attachment that is realized, for example, by means of a metal body to which cooling material is attached.

In addition, in the embodiment according to FIG. 2 which is shown, the skin contact element 13 is resiliently mounted or floats in the direction of the double arrow A. The skin contact element 13 can also be designed to be able to tilt to ensure that a good contact of the skin contact surface 11 with the skin is maintained. The skin contact surface 11 can also be designed to be malleable, for example in that the front area 15 that is permeable for the application substance 80 can be compressed. To that end, the front area 15 can be made, for example, out of a sponge material that can be pressed together or a fleece. The front area in particular can have good thermal conductivity so that heat energy is drawn from the skin by contact cooling.

Prior to use of the hair removal device according to FIG. 2, the application substance 80 may have to be cooled as described above. This can be done by means of the cooling device 21 if, for example, the hair removal device is attached to the line voltage. However, it can also be provided that the reservoir 20 and/or the skin cooling device 10 or one part of the skin cooling device 10 that comprises the reservoir 20 is cooled externally, for example in a freezer. Regardless of the cooling process used, the reservoir 20 can be designed to be replaceable so that an empty reservoir can be easily replaced by a new reservoir, which in particular makes it possible to provide different application substances for different hair removal processes. In the case of hair removal by means of epilation, for example, an application substance for epilation in the face area that is different from the one used for epilation in the leg area can be used.

In a further embodiment (not shown in any figure), the application substance can even be attached to a skin contact element main body in a solid state, in which case the surface of the solid application substance forms the skin contact surface. In that case, the skin contact element is formed by the skin contact element main body and the solidified application substance that is arranged on it. A solid application substance can be achieved, for example, by freezing a liquid or gel- or cream-type of application substance, which then is distributed by rubbing it onto the skin During use, the frozen application substance then cools the skins by means of contact cooling, while at the same time, the warmth of the skin melts the application substance that is applied to the skin by moving the skin contact surface across the skin, which then, as a result of the effects described above such as evaporation and cooling ingredients, increases the cooling of the skin beyond that achieved by contact cooling alone. In the case of a solid application substance cooled to room temperature (21° C.), the skin is cooled by the contact with the application substance and the application substance is distributed by rubbing it onto the skin. By means of a pretensioned holder of the skin cooling unit, the skin contact surface of the skin cooling unit always remains in contact with the skin, even if the application substance melts or is rubbed off.

Figure 3:
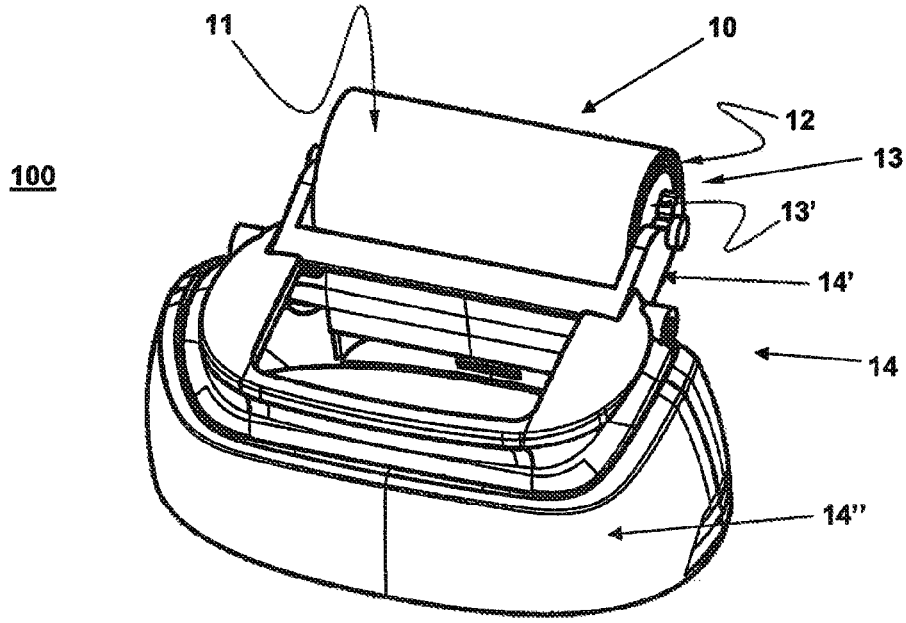
FIG. 3 shows an attachment to a hair removal device, wherein the attachment comprises a skin cooling unit in an exemplary embodiment.

FIG. 3 shows an attachment 100 for a hair removal device. In the embodiment shown, the attachment 100 comprises the skin cooling unit 10, which in this case is executed as a cylindrical unit, and a holder 14, which holds the skin cooling unit 10. At the same time, the removable holder 14 is attached to the hair removal device, for example by clamps or clips, and to the pretensioned holder lever 14' of the skin cooling unit 10. The pretensioning is achieved by means of springs arranged inside the attachment 100 (reference number 19 in FIG. 4). The cylindrical skin cooling unit 10 has protrusions that protrude along the side of its rotating axis. These removable protrusions can be clipped onto corresponding companion pieces of the holder lever 14'. As a result, the skin cooling unit 10 can be removed from the holder 14 and replaced by to another skin cooling unit. In addition, the configuration of the protrusions and companion pieces allows the skin cooling unit 10 to rotate. Thus, if the hair removal unit with attached attachment 100 is pressed against the skin and moves across the skin, the friction between skin cooling unit 10 and skin puts the skin cooling unit 10 into rotation. As a result, the entire skin contact surface 11 comes into contact with the skin The skin contact surface 11 of the skin cooling unit 10 is formed by the surface of the cylindrical center part of the skin cooling unit 10. The skin cooling unit 10 consists of a skin contact element main body 13', which in this case is in the form of a cylinder. Attached to the skin contact element main body 13' is a layer of material 12 like the one described in connection with FIG. 1, wherein an application substance is inserted into the layer of material 12, for example a fleece. Layer of material 12 and skin contact element main body 13' form the skin contact element 13.

An attachment 100, which comprises the skin cooling unit 10, allows a hair removal device to be used even without skin cooling unit 10 or, for example, allows other attachments (optionally with other skin cooling units that can be chosen depending on how they are intended to be used) to be used along with the hair removal device.

In one embodiment (not shown here), the attachment 100 is attached to an application substance feed line by means of clips on the hair removal device. In such a case, an optionally replaceable reservoir for the application substance is provided in the hair removal device, and during operation the application substance is fed to the skin cooling unit 10.

FIG. 4 shows a cross-cut attachment 100 as in FIG. 3, but with another exemplary embodiment of the skin cooling unit 10. The attachment again consists of the holder 14 and the skin cooling unit 10. The holder 14 consists of the holder lever 14' and the attachment head 14".

In this case, the skin cooling unit 10 held by the holder lever 14' has a skin contact surface 11 that forms the surface of a front area 15 that is permeable for the application substance 80. The front area 15 forms an outer casing area of the skin contact element 13. The front area 15 is arranged on a skin contact main body 13'. Inside the skin contact element main body 13' is a reservoir 20 in which is found the application substance 80. In the embodiment shown, the skin contact element main body 13' has perforations 17 that are executed as holes or pores having low diameters. The diameter is chosen so that a sufficient amount of application substance 80 flows through the perforations 17 during use of the hair removal device, which substance then can be applied to the skin over the front area 15 that is permeable for the application substance 80. The skin unit 10 can be cooled prior to use, for example, by keeping it in a freezer, and/or the application substance 80 can be cooled separately, for example in an additional container. In the case of separate cooling, the cooled application substance 80 is filled into the reservoir 20 through an opening (not shown) that can be closed prior to use of the hair removal device. This prevents the application substance 80 from passing through the perforations 17 prior to use. In addition, it can be provided that the skin contact element has an additional reservoir (not shown) that holds cooling material. The front area 15 of the skin contact element 13 can be designed to be replaceable so that with repeated use of the skin cooling unit 10, a front area 15 contaminated by skin and hair particles and old application substance can be disposed of and replaced by a fresh and clean front area.

Figure 5:
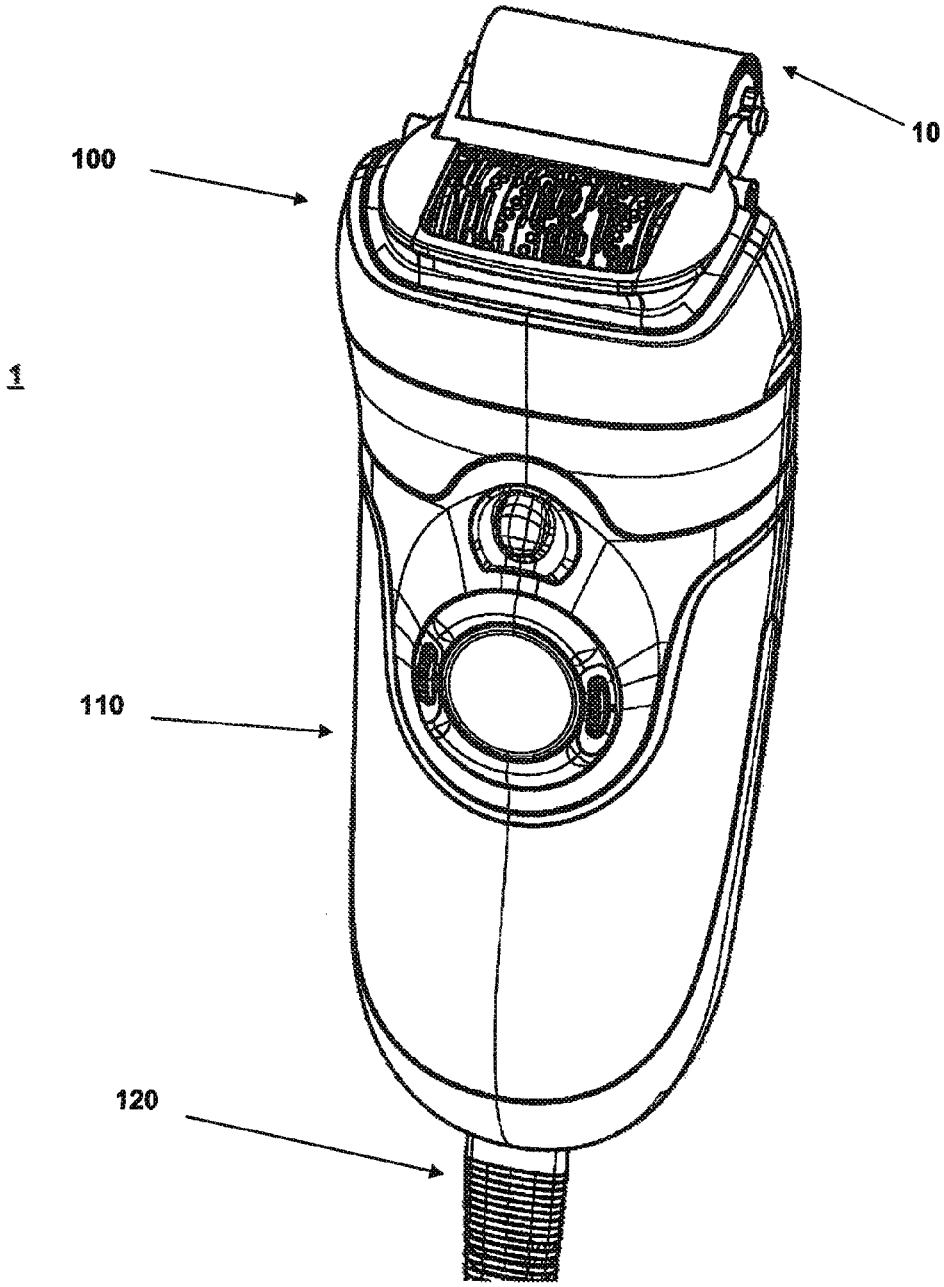
FIG. 5 shows a hair removal device that comprises an attachment with a skin cooling unit.

FIG. 5 shows a hair removal device 1 executed as an epilation device that comprises an attachment 100 and a hair removal device main body 110. The hair removal device main body 110 can be used as a hair removal device even without the attachment. The skin cooling unit 10 is arranged on the attachment 100, as shown in FIG. 3. The hair removal device 1 is connected to the line voltage by a cable 120. Alternatively or in addition, the hair removal device 1 can also be operated using a secondary battery. Both the attachment 100 and the hair removal device main body 110 have elements for mutual coupling. Thus, for example, the attachment 100 can have protrusions that help hold the attachment 100 in depressions in the hair removal device main body 110.

The described embodiments are not designed in such a way that they could justify separating realization features in an application. Each combination of the named features in the various exemplary embodiments that is obvious to the person skilled in the art should be included in the subject matter of the application.

The measurements and values named herein are not meant to be understood as strictly limited to the exact numerical values indicated. Unless otherwise indicated, each such measurement should rather comprise both the value indicated and a functionally equivalent range that also embraces this value. For example, a measurement indicated as "40 mm" should be understood to mean "around 40 mm."

What is claimed is:

1. Hair removal device comprising a hair removal unit and a skin cooling unit, wherein the skin cooling unit has a skin contact surface and the skin cooling unit is designed to apply, during use of the hair removal device, an application substance onto the skin via the skin contact surface;

wherein at least one part of the skin cooling unit comprising the skin contact surface is designed as an attachment that is configured to be reversibly connected to the hair removal device, and to be cooled in a cooling device prior to the process of hair removal;

wherein the skin cooling unit contains a rotatable skin contact element whose surface forms at least part of the skin contact surface and is permeable for the application substance; and wherein the skin contact surface is pretensioned against the skin through springs arranged inside the attachment.

2. Hair removal device according to claim 1 wherein the skin contact surface is at least partially formed by the surface of a layer of material that is replaceable.

3. Hair removal unit according to claim 1 wherein the application substance is inserted into the layer of material.

4. Hair removal device according to claim 1 wherein the skin contact surface is at least partially formed by the surface of solidified application substance.

5. Hair removal device according to claim 1 wherein the skin cooling unit comprises a reservoir for the application substance.

6. Method for hair removal using the hair removal device of claim 1, comprising the steps:

removing the attachment from the hair removal device and cooling the application substance in a separate cooling device;

passing over a skin area with said hair removal device, wherein a skin contact surface of skin cooling unit is brought into contact with the skin;

applying cooled application substance to the skin by means of the skin contact surface; and removing hair from the skin with a hair removal unit of said hair removal device.

* * * * *